US005417819A

United States Patent [19]

Askin et al.

[11] Patent Number: 5,417,819

[45] Date of Patent: May 23, 1995

[54] METHOD FOR DESMUTTING ALUMINUM ALLOYS HAVING A HIGHLY REFLECTIVE SURFACE

[75] Inventors: Albert L. Askin, Lower Burrell; Paul B. Schultz, Export, both of Pa.

[73] Assignee: Aluminum Company of America, Pittsburgh, Pa.

[21] Appl. No.: 184,025

[22] Filed: Jan. 21, 1994

[51] Int. Cl.[6] ..... C25F 3/20; C09K 13/08; C11D 7/54; C23G 1/02

[52] U.S. Cl. ..... 204/129.1; 204/141.5; 204/129.95; 252/79.3; 252/101; 428/687; 428/938; 134/3

[58] Field of Search ..... 204/141.5, 129.95; 134/3; 252/79.3, 101, 142–157; 428/687, 938

[56] References Cited

U.S. PATENT DOCUMENTS

| | | | |
|---|---|---|---|
| 2,719,079 | 9/1955 | Murphy | 252/79.3 |
| 2,719,781 | 10/1955 | Hesch | 252/79.3 X |
| 2,965,521 | 12/1960 | Bomberger et al. | 134/3 |
| 3,155,556 | 11/1964 | Neunzig | 156/21 |
| 3,954,645 | 5/1976 | Otrhalek et al. | 252/106 |
| 4,614,607 | 9/1986 | Loch | 252/142 |
| 4,737,246 | 4/1988 | Powers et al. | 204/58 |
| 4,851,148 | 7/1989 | Yamasoe et al. | 134/3 X |
| 4,883,541 | 11/1989 | Tadros | 134/3 |
| 4,886,616 | 12/1989 | Yamasoe et al. | 134/3 X |
| 5,052,421 | 10/1991 | McMillen | 134/2 |
| 5,227,016 | 7/1993 | Carlson et al. | 156/665 |

*Primary Examiner*—Donald R. Valentine
*Attorney, Agent, or Firm*—David W. Pearce-Smith

[57] ABSTRACT

A method of forming a highly reflective surface on aluminum alloys, the composition comprising (a) brightening the surface of a body formed from an aluminum alloy; and (b) desmutting the freshly brightened body in a bath. The desmutting bath comprises 10–100 volume percent nitric acid; 0–60 volume percent sulfuric acid; 0–50 volume percent water; and at least 15 grams per liter of a source of bifluoride. Ammonium fluoride is the preferred source of fluoride.

24 Claims, 1 Drawing Sheet

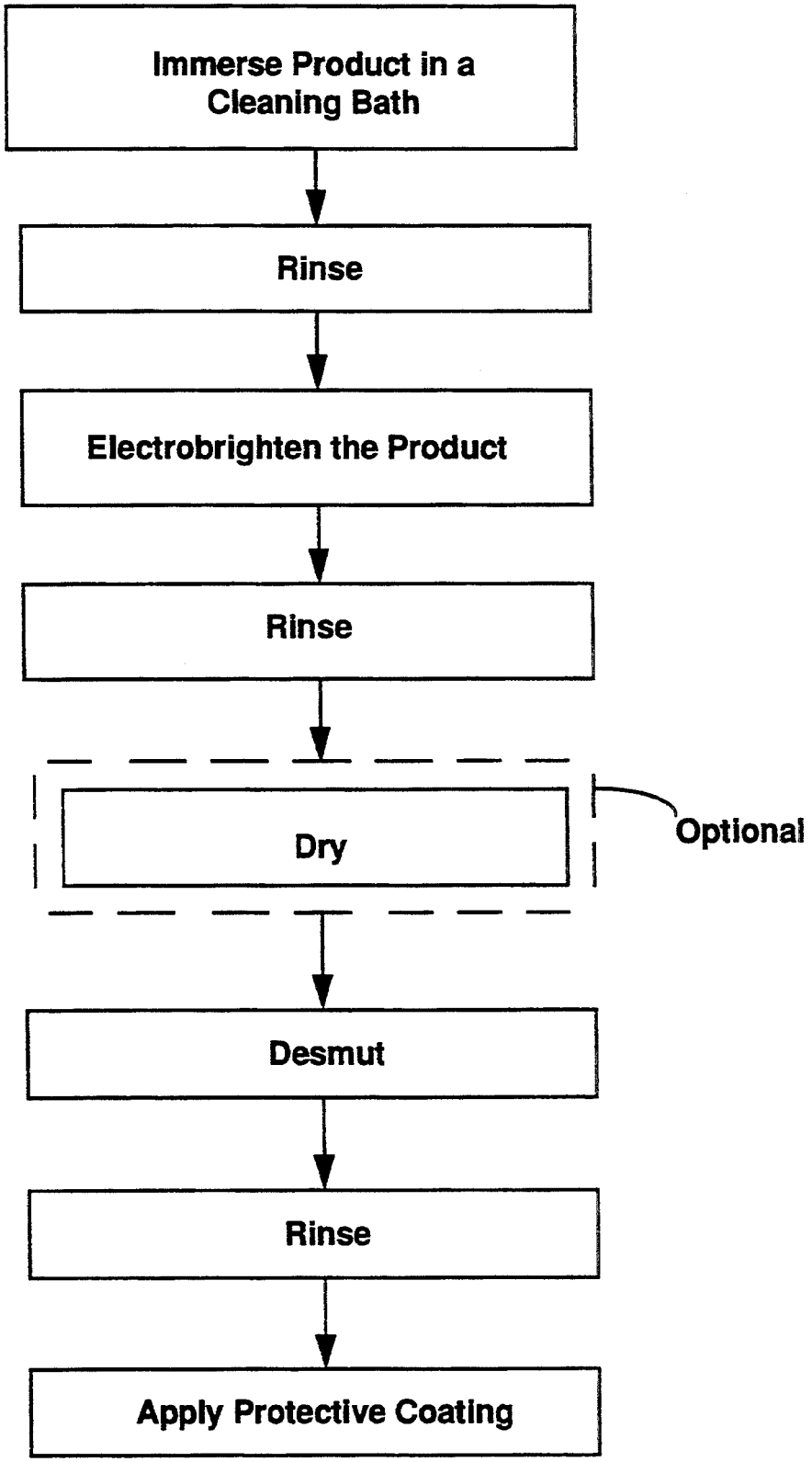
Immerse Product in a Cleaning Bath
Rinse
Electrobrighten the Product
Rinse
Dry
Optional
Desmut
Rinse
Apply Protective Coating

METHOD FOR DESMUTTING ALUMINUM ALLOYS HAVING A HIGHLY REFLECTIVE SURFACE

TECHNICAL FIELD

The present invention relates to methods and compositions for desmutting aluminum alloys possessing highly reflective surfaces. More particularly, the method and chrome-free compositions of the present invention relate to desmutting aluminum alloys possessing highly reflective surfaces without etching the reflective surface.

BACKGROUND ART

Although aluminum is ordinarily considered to be a bright metal, it is often presents a dull or matte-like finish due to surface roughness resulting from the operations used to shape it, i.e. rolling, casting, extrusion and the like. For some applications it is desired that aluminum have a highly reflective surface. The term "highly reflective" is used herein to mean a surface which is glossy or polished and capable of reflecting a clear image.

Chemical and electrochemical solutions have been developed to create a highly reflective surface on aluminum alloys and aluminum alloy bodies. These solutions are not entirely satisfactory. Chemical solutions do not create a surface will a mirror-like surface. Electrochemicals create a mirror-like surface however the process leaves a fine particulate material on the surface of the metal. This material is referred to as "smut".

The composition of the smut varies with the alloy and the electrochemical and chemical solution used to polish the surface but is generally composed of the oxides of the alloying metals. The smut is mostly aluminum oxide as well as those metallic compounds that do not dissolve during the polishing. The smut dulls the metal surface and detracts from the polished surface appearance. In addition, if it is not removed, subsequent deposits of chemical conversion coatings and the like will not be uniform and will be loosely held where the smut is not removed.

The electrochemical solutions leave a smut that is particularly difficult to remove without etching the surface. Chromated acid solutions have been found to be effective at removing smut caused by electrochemical solutions. However, these solutions must be used at temperatures above 160° F. for them to be effective. In addition, chromated acid deoxidizing solutions are environmentally undesirable and the Environmental Protection Agency (EPA) has enacted regulations which restrict chromium effluents. Consequently, in more and more finishing facilities, chromium treatment plants are being installed at great expense. Furthermore, restrictions on solid chromium disposal is also expensive.

Accordingly, it would be advantageous to provide a method for removing the smut from the surfaces of aluminum alloys possessing highly reflective surfaces which does not destroy the high gloss on the surface of aluminum or diminish the ability of the surface to reflect a clear image.

Another object of the invention is to provide a chrome-free method for removing the smut from the surfaces of aluminum alloys possessing highly reflective surfaces which does not destroy the high gloss on the surface of aluminum or aluminum alloy bodies.

Another object of the invention is to provide a chrome-free method for removing the smut from the surfaces of aluminum alloys possessing highly reflective surfaces which is effective at room temperature.

Another object of the invention is to provide highly reflective sheet of aluminum alloys.

These and other objects and advantages of the present invention will be more fully understood and appreciated with reference to the following description.

SUMMARY OF THE INVENTION

Disclosed is a method of forming a highly reflective surface on aluminum alloys products. The method comprises: (a) brightening the surface of a body formed from an aluminum alloy; and (b) desmutting the freshly brightened body in a bath. The desmutting bath comprises 10–100 volume percent nitric acid; 0–60 volume percent sulfuric acid; 0–50 volume percent water; and at least 15 grams per liter of a source of fluoride. Ammonium bifluoride is the preferred source of fluoride. It has also been found that 5–20 volume percent of phosphoric acid is useful for removing more tenacious types of smut.

Another aspect of the present invention is electrobrightened sheet product having a highly reflective surface. The sheet product formed by a method comprising: (a) cleaning a sheet formed from an aluminum alloy; (b) electrobrightening the sheet; and (c) desmutting the freshly brightened sheet in a bath, the bath comprising: 10–100 volume percent nitric acid; 0–60 volume percent sulfuric acid; 0–50 volume percent water; and at least 15 grams per liter of a source of fluoride. In a preferred embodiment, the sheet product is formed into lighting sheet. In another preferred embodiment, the sheet product is formed into automotive trim or automotive bumpers.

Still another aspect of the present invention is a chrome-free bath for desmutting the surface of electropolished aluminum alloys. The bath comprises: (a) a solution comprising: 10–100 volume percent nitric acid; 0–60 volume percent sulfuric acid; and 0–50 volume percent water; and (b) at least 15 grams per liter of a source of fluoride.

BRIEF DESCRIPTION OF THE DRAWING

Other features of the present invention will be further described in the following related description of the preferred mode and embodiment which is to be considered together with the accompanying drawing wherein like figure refers to like parts and further wherein:

The sole FIGURE is a flow diagram depicting the process steps in the process of the present invention.

MODE FOR CARRYING OUT THE INVENTION

The term "brightening" is used herein to mean improving the clarity or distinctness of an image reflected by a metal surface.

The term "aluminum alloy" is used herein to mean pure aluminum and alloys thereof in which the weight percent of aluminum in the alloy is at least 98 wt. %.

Turning first to the FIGURE, there is illustrated the method of creating highly reflective surfaces on aluminum alloys. Briefly, the process involves cleaning the metal, rinsing the cleaned metal, electrobrightening the cleaned metal, rinsing the brightened metal, desmutting, rinsing and then applying protective coating to preserve the brightened surface. The sheet may be dried before desmutting without any deleterious effect on the finished surface of the end product.

In a preferred commercial operation the process shown in the FIGURE is a continuos process. In such an operation, the tanks are arranged in a fashion that permits the sheet to move form one tank to the next without delay. The residence time that the sheet remains in a tank is timed to facilitate the continuous flow of material though the process.

To prepare the surface of sheet or plate for brightening, the sheet is immersed in a cleaning bath. The composition of the cleaning bath is not critical to the invention and it may be an alkali or acid solution. The cleaning bath removes oils adhering to the surface of the sheet and lubricants used in the process of rolling ingot and/or billet into sheet or plate. The oils would otherwise interfere with the electrobrightening of the sheet.

One alkaline cleaner solution that has been found to be effective is commonly referred to as A31K which is a diminution of Elf Atochem A31K. A31K is commercially available from Atochem, N.A., Cornwells Heights, Pa. The A31K solution is prepared by adding ½ pounds of A31K per gallon of water. The solution is heated to approximately 140° F., and the plates are immersed in the heated solution for approximately 1–2 minutes.

After cleaning, the sheet or plate is immediately rinsed to remove residue from the cleaning bath. It is important to rinse the sheet before the cleaning solution dries. Preferably, the rinse water is deionized water; however, it is not critical. Tap water may be successfully employed to remove cleaning bath from the surface of the sheet.

After the rinse, the sheets are immediately placed in an electrobrightening bath since the dust particles and the like will settle on the surface and interfere with uniformity of the electrobrightening process. If the plates are not immediately placed in the electrobrightening solution, they may need to be re-rinsed and/or re-cleaned to insure the uniformity of the electrobrightening treatment on the surface of the metal.

The electrobrightening bath is heated to approximately 125°–135° F. and a voltage of 30–40 V is used to electrobrighten the sheet. The exact voltage used will depend on the temperature of the bath. The higher the bath temperature, the lower the voltage required to brighten the metal sheet. The metal remains in the brightening bath for approximately one minute.

After electropolishing, the metal plate is removed from the solution and rinsed in water. Once again, the water is preferably deionized water. It is not critical that the plates be immediately desmutted. They can be allowed to dry. Dry sheets can be desmutted without diminishing the quality of the final product. However, in the continuous process contemplated by the invention, the freshly rinsed plates will be immediately placed in the desmutting tank.

The electrobrightening process leaves areas of insoluble residue or smut on the surface of the metal. The smut dulls the surface of the metal and interferes with the ability of the surface to reflect a clear image. In addition, if the smut is not removed, when a protective coating is applied, the coating will poorly adhere to the surface.

The sheet is then placed into a desmutting solution to remove the smut and expose the brightened surface. The effectiveness of the desmutting bath must be balanced so that it is sufficiently potent to remove the smut and expose the mirror-like surface formed in the electrobrightening bath; and yet not excessively potent so that it attacks the freshly electropolished surface and etches the mirror-like surface.

The time that the plates remain in the bath is critical, since many solutions which are effective in desmutting will, if given enough time, etch the brightened surface. Since it is contemplated that the cleaning steps through desmutting will be part of a continuous system, with sheets of aluminum moving from one tank to the next, it is desirable that the desmutting solution produce the desired effect within a period of from about 0.5 to about 2 minutes.

It has been found that an optimum desmutting may be achieved by the use of a solution of from about 10–100 vol. % nitric acid, 0–60 vol. % sulfuric acid and 0–50 vol. % water and at least 15 g/l of a source of fluoride.

Ammonium bifluoride is the preferred source of fluoride used in the desmutting bath. Other sources of fluoride include hydrofluoric acid, sodium fluoride, potassium fluoride, sodium bifluoride and potassium bifluoride. In addition, combinations of the aforementioned fluoride-containing compounds can be used to obtain the desired level of fluoride.

It is preferred that the desmutting bath contain less than 50 vol. % water. Surprisingly, higher levels of water, although effective for removing smut, have been found to etch the polished surface. Similarly, it is desirable to maintain the level of sulfuric acid below 60 vol. % to avoid undesirable etching of surface. However for cost reasons, it is considered to be highly desirable to include as much water in the desmutting bath as possible, providing of course that the bath does not etch the surface of the sheet.

The temperature of the bath is also critical. Many solutions which are not effective in desmutting at room temperature will, if heated, etch the brightened surface. Preferably, the desmutting bath is maintained at a temperature between 60°–110° F. It is desirable to desmut at a room temperature to avoid the cost associated with heating the bath above room temperature.

For smut that is more resistant to removal, a substitution of 5–20 vol. % phosphoric acid has been found to be effective. However, for most electrobrightening baths, it is believed that there is no need to resort to the use of phosphoric acid. Maintaining the amount of phosphoric acid at the lowest possible level is considered to be highly desirable from the standpoint of cost. Phosphoric acid is approximately five times more expensive than nitric acid or sulfuric acid. Therefore, there is a significant cost advantage in the use of a phosphoric acid free desmutting solution. A maximum of 20–25 vol. % phosphoric acid is considered to be the limit for maintaining a low cost. The use of higher amounts of phosphoric acid desmuts without etching, however from a cost standpoint is it is considered to be undesirable.

It has been found that the tenacity of the smut is related to the composition of the electrobrightening bath. It has been discovered that for plates that have been electrobrightened using inorganic based electrobrightening solutions, the substitution of at least 5 vol. % phosphoric acid is needed to remove smut and expose the mirror-like surface. Inorganic-based electropolish solutions that brighten sheet that benefit from the addition of phosphoric acid in the desmutting bath include those using ethylene glycol as a major component.

After desmutting, the metal is rinsed and further processed with a protective coating which acts to preserve the mirror-like finish on the sheet. Protective coatings include anodizing, painting, roll coating, electrocoating and lacquering. The type of protective coating is not considered to be essential to the present invention.

The benefit of the present invention is illustrated in the following examples. All of the examples were performed on electropolished aluminum sheet. The aluminum alloy was rolled AA5657 or AA1100. It is believed that these alloys can be used interchangeably in the present invention. The aluminum sheet was prepared as follows. First the sheet was immersed for two minutes in an alkaline solution formed using one half pound of A31K per gallon of water. The alkaline cleaning solution was heated to approximately 140° F. The sheets are rinsed and then brightened in an electropolish solution and rinsed with deionized water. The desmutting solutions were formed using acids in the following concentrations:

$HNO_3$—68–70%

$H_2SO_4$—98–100%

$H_3PO_4$—84–86%

EXAMPLES 1–19

Aluminum plate formed from Aluminum Association alloy AA5657 was electrobrightened using a solution formed from ELECTROPOL 100, which is commercially available from Albright Wilson of Richmond, Va. The solution was heated to 135° F. prior to immersion of the plates. The voltage used in the electrobrightening process was approximately 35 volts (±5 volts depending on the actual temperature of the bath). The plates remained in the solution for approximately one minute.

The brightened plates were rinsed and then immersed in a solution to remove the smut which accumulated on the surface of the metal during the chemical brightening. The compositions of the solutions are set forth in Table 1. The source of bifluoride used in the examples was ammonium bifluoride. All of the desmutting solutions had a temperature of approximately 80° F. The plates were immersed in the desmutting solutions for one (1) minute. The effectiveness of the desmutting solutions in removing the smut remaining of the plates after the brightening bath are set forth in Table 1. The total water includes the volume percent water in the acids. Table 1 also indicates if the surface of the brightening plates were etched during the desmutting immersion.

TABLE I

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 1 | 17 | 83 | 0 | 0 | 4 | 30 | No | — |
| 2 | 15 | 75 | 10 | 0 | 13 | 30 | No | — |
| 3 | 13 | 67 | 10 | 0 | 13 | 30 | No | — |
| 4 | 13 | 62 | 15 | 0 | 18 | 30 | No | — |
| 5 | 12 | 58 | 30 | 0 | 33 | 30 | Yes | No |
| 6 | 10 | 50 | 40 | 0 | 42 | 30 | Yes | No |
| 7 | 8 | 42 | 50 | 0 | 52 | 30 | Yes | Yes |
| 8 | 0 | 70 | 30 | 0 | 30 | 30 | No | — |
| 9 | 0 | 100 | 0 | 0 | 0 | 30 | No | — |
| 10 | 50 | 50 | 0 | 0 | 0 | 30 | No | — |
| 11 | 45 | 45 | 10 | 0 | 26 | 30 | No | — |
| 12 | 40 | 40 | 20 | 0 | 29 | 30 | No | — |
| 13 | 35 | 35 | 30 | 0 | 38 | 30 | Yes | No |
| 14 | 30 | 30 | 40 | 0 | 47 | 30 | Yes | Yes |
| 15 | 90 | 0 | 10 | 0 | 30 | 30 | Yes | No |
| 16 | 83 | 17 | 0 | 0 | 18 | 30 | Yes | No |
| 17 | 75 | 15 | 10 | 0 | 26 | 30 | Yes | No |
| 18 | 67 | 13 | 20 | 0 | 25 | 30 | Yes | No |
| 19 | 58 | 12 | 30 | 0 | 43 | 30 | Yes | Yes |

The results of Table 1 indicate that at 30 grams/liter $NH_4$-fluoride, the volume per water must be below 50 vol. % to avoid etching the surface of the plates. In addition, the volume percent sulfuric acid should be maintained below 60 vol. % to avoid etching the surface of the plates.

EXAMPLES 20–22

The procedure of Examples 1–19 were repeated except that the amount of bifluoride in the solution was changed to 15 grams per liter instead of 30 grams per liter. The composition of the solutions and results are set forth in Table 2.

TABLE 2

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 20 | 12 | 58 | 30 | 0 | 33 | 15 | No | — |
| 21 | 35 | 35 | 30 | 0 | 38 | 15 | Yes | No |
| 22 | 58 | 15 | 30 | 0 | 23 | 15 | Yes | No |

The results of Table 2 illustrate that as the amount of ammonium fluoride in the solution is decreased (half of the level in Table 1), the lower limit of nitric acid needed to remove smut is increased.

EXAMPLES 23–25

The procedure of Examples 1–19 were repeated except that the amount of bifluoride in the solution was changed to 60 grams per liter instead of 30 grams per liter. The composition of the solutions and results are set forth in Table 3.

TABLE 3

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 23 | 12 | 58 | 30 | 0 | 33 | 60 | Yes | No |
| 24 | 35 | 35 | 30 | 0 | 38 | 60 | Yes | No |
| 25 | 58 | 12 | 10 | 0 | 23 | 60 | Yes | No |

The results of Table 3 illustrate that the amount of ammonium fluoride in the solution can be increased from the level of Table 1 without affecting the ability of the solution to remove smut.

EXAMPLES 25–27

The procedure of Examples 1–19 were repeated except that the amount of bifluoride in the solution was changed to 100 grams per liter instead of 30 grams per liter. The compositions of the solutions and results are set forth in Table 4.

TABLE 4

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 25 | 12 | 58 | 30 | 0 | 33 | 100 | Yes | No |
| 26 | 35 | 35 | 30 | 0 | 38 | 100 | Yes | No |
| 27 | 58 | 12 | 10 | 0 | 23 | 100 | Yes | No |

The results of Table 4 illustrate that the amount of ammonium fluoride in the solution can be increased from the level of Table 1 without affecting the ability of the solution to remove smut.

EXAMPLES 28–32

The procedure of Examples 1–19 were repeated except that a different commercial electropolish solution was used to brighten the plates. The electropolish solution contains phosphoric acid ethylene glycol as major components. The composition of the solutions and results are set forth in Table 5.

TABLE 5

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 28 | 50 | 0 | 5 | 50 | 21 | 30 | Yes | No |
| 29 | 50 | 0 | 10 | 50 | 26 | 30 | Yes | No |
| 30 | 50 | 0 | 15 | 50 | 31 | 30 | Yes | No |
| 31 | 50 | 0 | 20 | 50 | 36 | 30 | Yes | No |
| 32 | 60 | 0 | 0 | 40 | 15 | 30 | Yes | No |

The results of Table 5 illustrate that phosphoric acid can be used instead of sulfuric acid to remove smut without etching. However, since the cost of phosphoric acid is more than five-fold than that of sulfuric acid, the substitution of phosphoric acid for sulfuric acid is not considered to be cost effective.

EXAMPLES 33–48

The procedure of Examples 1–19 were repeated except that the electropolish solution of Examples 28–32 was used to brighten the plates. The composition of the solutions and results are set forth in Table 6.

TABLE 6

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 33 | 10 | 0 | 0 | 90 | 10 | 135 | Yes | No |
| 34 | 20 | 0 | 5 | 80 | 16 | 135 | Yes | No |
| 35 | 20 | 0 | 10 | 80 | 21 | 135 | Yes | No |
| 36 | 20 | 0 | 15 | 80 | 26 | 135 | Yes | No |
| 37 | 50 | 0 | 0 | 50 | 16 | 135 | Yes | No |
| 38 | 50 | 0 | 0 | 50 | 16 | 135 | Yes | No |
| 39 | 50 | 0 | 5 | 50 | 24 | 135 | Yes | No |
| 40 | 50 | 0 | 10 | 50 | 26 | 135 | Yes | No |
| 41 | 50 | 0 | 0 | 50 | 16 | 115 | Yes | No |
| 42 | 50 | 0 | 0 | 50 | 16 | 105 | Yes | No |
| 43 | 50 | 0 | 0 | 50 | 16 | 85 | Yes | No |
| 44 | 50 | 0 | 0 | 50 | 16 | 65 | Yes | No |
| 45 | 50 | 0 | 0 | 50 | 16 | 45 | Yes | No |
| 46 | 50 | 0 | 0 | 50 | 16 | 25 | Yes | No |
| 47 | 50 | 0 | 0 | 50 | 16 | 10 | No | — |
| 48 | 50 | 0 | 0 | 50 | 16 | 5 | No | — |

The results of Table 6 indicate that for the more tenacious smut, more than 10 g/l $NH_4F$—HF is required to remove the smut. However, the level of $NH_4$—HF can be increased to 135 g/l without etching the desmutted surface.

EXAMPLES 49–51

The procedure of Examples 1–19 were repeated except that the electropolish solution of Examples 28–32 was used to brighten the plates. The composition of the solutions and results are set forth in Table 7.

TABLE 7

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 49 | 25 | 35 | 30 | 10 | 34 | 50 | Yes | No |
| 50 | 25 | 35 | 30 | 10 | 34 | 90 | Yes | No |
| 51 | 25 | 35 | 30 | 10 | 34 | 130 | Yes | No |

The results of Table 7 indicate that for the more tenacious smut, increasing the level of $NH_4F$—HF above the 50 g/l does not etch the surface of the desmutted surface.

EXAMPLES 52–56

The procedure of Examples 1–19 were repeated except that the electropolish solution of Examples 28–32 was used to brighten the plates. The composition of the solutions and results are set forth in Table 8.

TABLE 8

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 52 | 25 | 35 | 35 | 5 | 38 | 90 | Yes | Yes |
| 53 | 25 | 35 | 30 | 10 | 34 | 90 | Yes | No |
| 54 | 22 | 30 | 30 | 18 | 37 | 90 | Yes | No |
| 55 | 20 | 35 | 35 | 10 | 40 | 70 | Yes | No |
| 56 | 20 | 35 | 35 | 10 | 40 | 135 | Yes | No |

The results of Table 8 indicate that for the more tenacious smut, the combination of high volume percent water (at 35 vol. %) and high levels of $NH_4F$—HF (90 g/l) etches the surface. Lowering the water or the level of $NH_4F$—HF used in preparing the desmutting bath creates a bath that does not etch the surface of the desmutted surface.

EXAMPLES 57–60

The procedure of Examples 1–19 were repeated except that the electropolish solution of Examples 28–32 was used to brighten the plates. The composition of the solutions and the temperature of the bath was changed. The bath temperature and the results are set forth in Table 9.

TABLE 9

| Example | $HNO_3$ (vol. %) | $H_2SO_4$ (vol. %) | Water (vol. %) | $H_3PO_4$ (vol. %) | Total Water | $NH_4F.HF$ g/l | Smut Removed | Surface Etched |
|---|---|---|---|---|---|---|---|---|
| 57 | 35 | 25 | 30 | 10 | 90 | 80 | Yes | No |
| 58 | 25 | 35 | 30 | 10 | 90 | 60 | Yes | No |
| 59 | 22 | 35 | 30 | 10 | 90 | 90 | Yes | Yes |
| 60 | 20 | 35 | 30 | 10 | 70 | 70 | Yes | No |

It is to be appreciated that certain features of the present invention may be changed without departing from the present invention. Thus, for example, it is to be appreciated that although the invention has been described in terms of a preferred embodiment in which the plate is formed from Aluminum Association alloy 5657, the alloys comprehended by the present invention include aluminum alloys containing about 98 percent or more by weight of aluminum (preferably more than 99 percent by weight aluminum) and one or more alloying elements. Among such suitable alloying elements is at least one element selected from the group of essentially character forming alloying elements consisting of manganese, zinc, beryllium, lithium, copper, silicon and magnesium. These alloying elements are essentially character forming for the reason that the contemplated alloys containing one or more of them essentially derive their characteristic properties from such elements. Alloys suitable for use in the present invention include Aluminum Association alloys 1050, 1060, 1100, 1145, 1175, 1200, 1230, 1235, 1345, 1350, 5005 and 5657.

Whereas the preferred embodiments of the present invention have been described above in terms of immersion of sheet or plates, it will be apparent to those skilled in the art that the present invention will so valuable in forming a highly reflective surface on a continuous coil or strip of metal. In brightening and desmutting a continuous coil, parts of the coil will have been completely desmutted and recoiled before other sections of the coil have been cleaned.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of forming a highly reflective surface on aluminum alloys, said composition comprising:

(a) cleaning a body formed from an aluminum alloy;

(b) electrobrightening said body; and (c) desmutting the surface of the freshly brightened body without etching, the desmutting in a bath to remove smut formed on the surface of the body during electrobrightening, said bath comprising:

10–100 volume percent nitric acid;

0–60 volume percent sulfuric acid;

0–50 volume percent water; and at least 15 grams per liter of a source of fluoride.

2. The method of claim 1 in which said electrobrightening is performed in an electrobrightening solution comprising ethylene glycol.

3. The method of claim 1 in which said bath further comprises 5–20 vol. % phosphoric acid.

4. The method of claim 1 in which said body is formed from an alloy containing at least 98 percent by weight aluminum.

5. The method of claim 1 in which said body is aluminum sheet.

6. The method of claim 1 in which said bath is maintained at a temperature between about 60° F. and about 100° F.

7. The method of claim 1 in which said body is immersed in said bath for less than 2 minutes.

8. The method of claim 1 in which said body is immersed in said bath for about 1 minute.

9. The method of claim 1 in which said bath comprises:

10–80 volume percent nitric acid;
10–60 volume percent sulfuric acid;
10–50 volume percent water; and
5–20 volume percent phosphoric acid.

10. The method of claim 1 in which said bath comprises:

10–50 volume percent nitric acid;
20–60 volume percent sulfuric acid; and
20–30 volume percent water; and
5–20 volume percent phosphoric acid.

11. The method of claim 1 in which said source of fluoride is selected from the group consisting of hydrofluoric acid, ammonium bifluoride, sodium fluoride, potassium fluoride, sodium bifluoride, potassium bifluoride and combinations thereof.

12. The method of claim 1 in which said source of fluoride is less than about 200 grams per liter of ammonium bifluoride.

13. The method of claim 1 in which said source of fluoride is about 30–150 grams per liter.

14. A chrome-free bath for desmutting the surface of electropolished aluminum alloys without etching the surface, said bath comprising:

(a) a solution comprising:
10–100 volume percent nitric acid;
0–60 volume percent sulfuric acid; and
0–50 volume percent water; and
(b) at least 15 grams per liter of a source of fluoride.

15. The bath of claim 14 in which said source of fluoride is selected from the group consisting of hydrofluoric acid, ammonium bifluoride, sodium fluoride, potassium fluoride, sodium bifluoride, potassium bifluoride and combinations thereof.

16. The bath of claim 14 in which said source of fluoride is less and 200 grams per liter.

17. The bath of claim 14 in which said source of fluoride is about 30–150 grams per liter.

18. A chrome-free bath for desmutting the surface of electropolished aluminum alloys without etching the surface, said bath comprising:

(a) a solution comprising:
10–80 volume percent nitric acid;
10–60 volume percent sulfuric acid; and
10–50 volume percent water; and
5–20 volume percent phosphoric acid; and
(b) at least 15 grams per liter of a source of fluoride.

19. A chrome-free bath for desmutting the surface of electropolished aluminum alloys without etching the surface, said bath comprising:

(a) a solution comprising:
10–50 volume percent nitric acid;
20–60 volume percent sulfuric acid; and
20–30 volume percent water; and
5–20 volume percent phosphoric acid; and
(b) at least 15 grams per liter of a source of fluoride.

20. Electrobrightened sheet product having a highly reflective surface, said sheet product formed by a method comprising:

(a) cleaning a body formed from an aluminum alloy;
(b) electrobrightening said body; and
(c) desmutting the freshly brightened body in a bath, said bath comprising:
10–100 volume percent nitric acid;
0–60 volume percent sulfuric acid;
0–50 volume percent water; and
at least 15 grams per liter of a source of fluoride.

21. The sheet product of claim 20 in which said body is lighting sheet.

22. The sheet product of claim 20 in which said body is automotive trim.

23. The sheet product of claim 20 in which said body is automotive bumpers.

24. Electrobrightened lighting sheet having a highly reflective surface, said lighting sheet formed by a method comprising:

(a) cleaning a body formed from an aluminum alloy;
(b) electrobrightening said body; and
(c) desmutting the freshly brightened body in a bath, said bath comprising:
10–100 volume percent nitric acid;
0–60 volume percent sulfuric acid;
0–50 volume percent water; and
at least 15 grams per liter of a source of fluoride.

* * * * *